US008397557B2

(12) United States Patent
Parrish et al.

(10) Patent No.: US 8,397,557 B2
(45) Date of Patent: Mar. 19, 2013

(54) DIAGNOSTIC METHOD AND APPARATUS FOR THERMAL REGENERATOR AFTER-TREATMENT DEVICE

(75) Inventors: Tony Parrish, Columbus, IN (US); Wilbur H. Crawley, Nashville, IN (US)

(73) Assignee: Emcon Technologies LLC, Wilmington, DE (US)

( * ) Notice: Subject to any disclaimer, the term of this patent is extended or adjusted under 35 U.S.C. 154(b) by 447 days.

(21) Appl. No.: 12/582,781

(22) Filed: Oct. 21, 2009

(65) Prior Publication Data

US 2011/0088447 A1 Apr. 21, 2011

(51) Int. Cl.
*G01L 27/00* (2006.01)

(52) U.S. Cl. ..... 73/114.41; 73/114.38; 73/114.43; 73/114.77

(58) Field of Classification Search ..... 73/1.71, 73/114.38, 114.31, 114.32, 114.41, 114.43, 73/114.69, 114.77

See application file for complete search history.

(56) References Cited

U.S. PATENT DOCUMENTS

| | | | | | |
|---|---|---|---|---|---|
| 4,494,375 | A | * | 1/1985 | Rao et al. | 60/296 |
| 4,520,624 | A | * | 6/1985 | Kiyota et al. | 60/286 |
| 4,538,413 | A | * | 9/1985 | Shinzawa et al. | 60/303 |
| 4,571,938 | A | * | 2/1986 | Sakurai | 60/303 |
| 4,651,524 | A | * | 3/1987 | Brighton | 60/274 |
| 4,987,738 | A | * | 1/1991 | Lopez-Crevillen et al. | 60/286 |
| 5,063,737 | A | * | 11/1991 | Lopez-Crevillen et al. | 60/286 |
| 5,105,621 | A | * | 4/1992 | Simmons et al. | 60/303 |
| 5,140,814 | A | * | 8/1992 | Kreutmair et al. | 60/303 |
| 5,320,523 | A | * | 6/1994 | Stark | 431/353 |
| 5,339,630 | A | * | 8/1994 | Pettit | 60/303 |
| 5,417,059 | A | * | 5/1995 | Hartel et al. | 60/276 |
| 5,605,453 | A | * | 2/1997 | Kenner et al. | 431/262 |
| 5,619,975 | A | * | 4/1997 | Schmidt et al. | 123/644 |
| 5,826,428 | A | * | 10/1998 | Blaschke | 60/303 |
| 5,829,248 | A | | 11/1998 | Clifton | |
| 6,694,727 | B1 | | 2/2004 | Crawley et al. | |
| 7,025,810 | B2 | * | 4/2006 | Crawley et al. | 95/278 |
| 7,118,613 | B2 | | 10/2006 | Crawley et al. | |
| 7,393,185 | B2 | * | 7/2008 | Scanderbeg et al. | 417/12 |

(Continued)

FOREIGN PATENT DOCUMENTS

EP 0576068 12/1993

OTHER PUBLICATIONS

International Search Report mailed Jun. 23, 2011.

(Continued)

*Primary Examiner* — David Rogers
(74) *Attorney, Agent, or Firm* — Carlson, Gaskey & Olds, PC

(57) ABSTRACT

A method and apparatus for identifying a component failure within a thermal regenerator operates as follows. The burner control unit monitors at least one of a fuel pump characteristic for a fuel pump and an ignition system characteristic for an ignition system. The fuel pump is used to supply fuel to a fuel-fired burner and the ignition system is used to ignite fuel supplied to the fuel-fired burner. The fuel pump characteristic is communicated to the burner control unit which compares the fuel pump characteristic to a predetermined fuel pump criteria. The ignition system characteristic is communicated to the burner control unit which compares the ignition system characteristic to a predetermined ignition system criteria. The burner control unit identifies a fuel pump failure when the fuel pump characteristic does not meet the fuel pump criteria, and identifies an ignition system failure when the ignition system characteristic does not meet the ignition system criteria.

21 Claims, 2 Drawing Sheets

U.S. PATENT DOCUMENTS

| | | | | |
|---|---|---|---|---|
| 7,891,177 | B2 * | 2/2011 | Ammineni et al. | 60/297 |
| 7,997,127 | B2 * | 8/2011 | Baker et al. | 73/114.41 |
| 2003/0221425 | A1 | 12/2003 | Posselt et al. | |
| 2004/0046562 | A1 * | 3/2004 | Virchow | 324/380 |
| 2004/0113628 | A1 * | 6/2004 | Miwa et al. | 324/379 |
| 2005/0109015 | A1 | 5/2005 | Birkby | |
| 2005/0150217 | A1 | 7/2005 | Crawley et al. | |
| 2005/0150221 | A1 | 7/2005 | Crawley et al. | |
| 2005/0153250 | A1 | 7/2005 | Taylor et al. | |
| 2005/0214127 | A1 * | 9/2005 | Scanderbeg et al. | 417/12 |
| 2007/0215110 | A1 * | 9/2007 | Stein et al. | 123/431 |
| 2008/0034733 | A1 | 2/2008 | Miller et al. | |
| 2008/0228341 | A1 * | 9/2008 | Orifij | 701/29 |
| 2009/0277164 | A1 * | 11/2009 | Arellano et al. | 60/311 |
| 2010/0175370 | A1 * | 7/2010 | Bunge | 60/277 |
| 2010/0294030 | A1 * | 11/2010 | Lucido et al. | 73/114.43 |
| 2010/0319329 | A1 * | 12/2010 | Khadiya | 60/295 |
| 2011/0011067 | A1 * | 1/2011 | Ren et al. | 60/297 |

OTHER PUBLICATIONS

International Preliminary Report on Patentability dated Apr. 24, 2012, mailed May 3, 2012.

* cited by examiner

DIAGNOSTIC METHOD AND APPARATUS FOR THERMAL REGENERATOR AFTER-TREATMENT DEVICE

TECHNICAL FIELD

The subject invention relates to a method and apparatus for identifying a component failure within a thermal regenerator system for a vehicle exhaust system.

BACKGROUND OF THE INVENTION

Untreated engine emissions, such as those generated by a diesel engine for example, include hydrocarbons, carbon monoxide, and other carbon based particulate matter which is also referred to as "soot." Vehicle exhaust systems include exhaust after-treatment devices that filter these contaminants. These devices include emission abatement components such as filters/traps that collect the contaminants. Periodically, the filter or trap is regenerated with a fuel-fired burner which burns off the collected matter.

State and federal regulations require that diesel engine exhaust after-treatment devices include diagnostics to detect system problems, and also require that these diagnostics be able to identify which component within the system is faulty.

SUMMARY OF THE INVENTION

A vehicle exhaust system includes a burner control unit that controls a thermal regenerator system and detects one or more system failures at a component level.

A method for identifying a component failure within the thermal regenerator includes the following steps. The burner control unit monitors at least one of a fuel pump characteristic for a fuel pump in the thermal regenerator system and an ignition system characteristic for an ignition system in the thermal regenerator system. The fuel pump is used to supply fuel to a fuel-fired burner and the ignition system is used to ignite fuel supplied to the fuel-fired burner. The fuel pump characteristic is communicated to the burner control unit which compares the fuel pump characteristic to a predetermined fuel pump criteria. The ignition system characteristic is communicated to the burner control unit which compares the ignition system characteristic to a predetermined ignition system criteria. The burner control unit identifies a fuel pump failure when the fuel pump characteristic does not meet the fuel pump criteria, and identifies an ignition system failure when the ignition system characteristic does not meet the ignition system criteria.

In one example, the burner control unit generates a warning indication with a corresponding specified component fault code to an end user in response to identification of any fuel pump and ignition system failures.

These and other features of the present invention can be best understood from the following specification and drawings, the following of which is a brief description.

DETAILED DESCRIPTION OF THE PREFERRED EMBODIMENT

Figure 1:
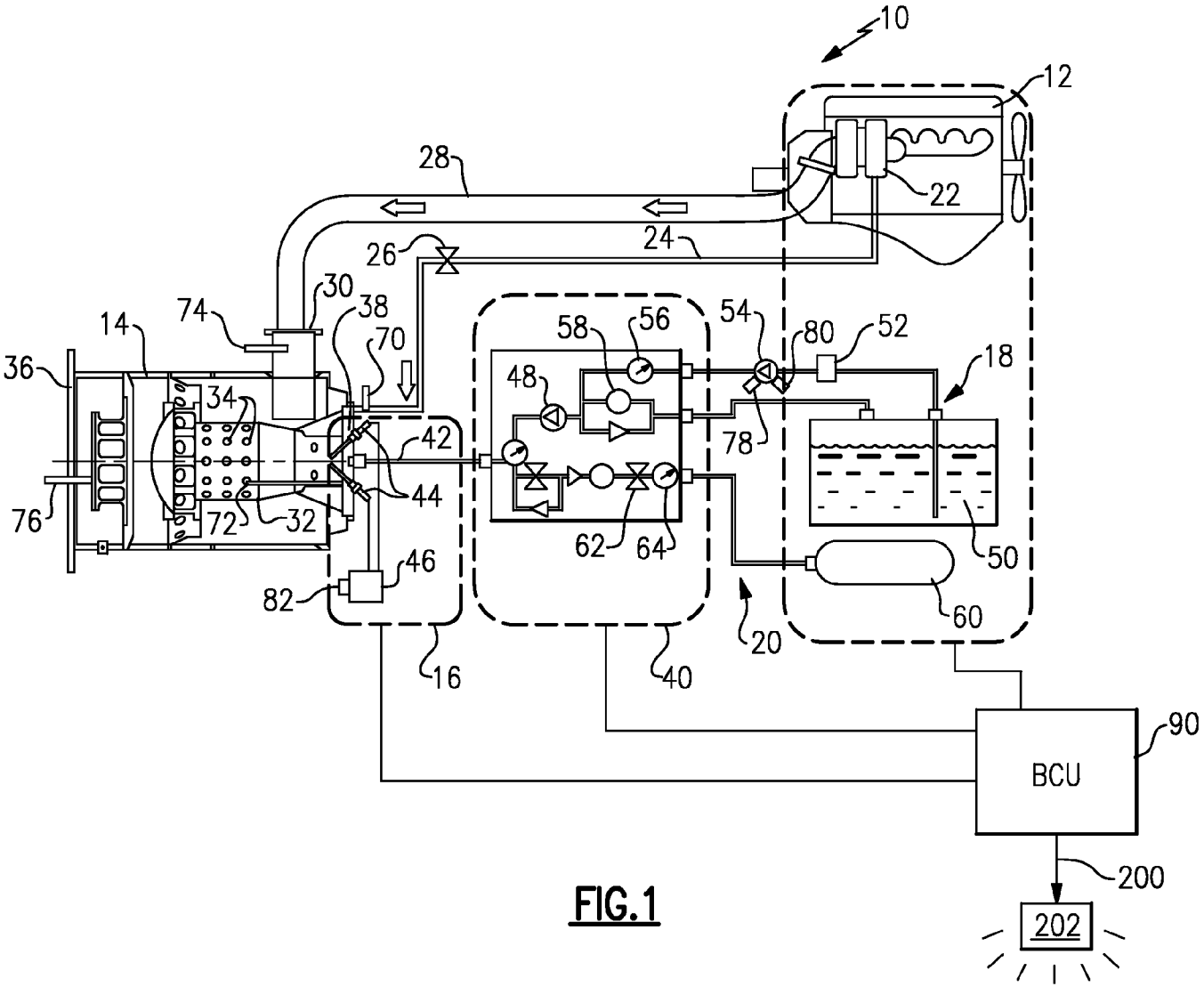
FIG. 1 is a schematic diagram of a thermal regenerator system incorporating the subject invention.

A thermal regenerator (TR) system 10 is shown in FIG. 1. The TR system 10 comprises a fuel-fired combustor that elevates exhaust temperature of a diesel engine 12 such that downstream emission abatement devices, such as filters/traps for example, can be activated. The TR system 10 includes a fuel-fired burner 14 that includes an ignition system 16, a fuel supply system 18 that supplies fuel to the ignition system 16, and an air supply system 20 that supplies air to the ignition system 16. Combustion air from a turbocharger 22 associated with the engine 12 is also delivered to the fuel-fired burner 14 via a combustion air path 24. A combustion air valve 26 is used to control combustion air flow within the combustion air path 24.

Exhaust gas from the engine 12 flows through an exhaust tube 28 and enters an inlet 30 to the fuel-fired burner 14. The fuel-fired burner 14 includes a combustion chamber 32 with a plurality of openings 34. Some of the exhaust gas flows from the inlet 30 and into the combustion chamber 32 via the openings 34, while a remainder of the exhaust gas flows around the combustion chamber 32 and exits at an outlet 36 from the fuel fired burner 14. The outlet 36 directs exhaust gases into filter or trap that is located immediately downstream of the fuel-fired burner 14.

The combustion chamber 32 includes a chamber inlet 38 that receives combustion air from the combustion air path 24 in combination with a mix of air/fuel supplied via an atomization module 40. The atomization module 40 receives fuel from the fuel supply system 18 and air from the air supply system 20. The atomization module 40 atomizes the fuel/air mixture which is sprayed from a nozzle 42 into the combustion chamber 32.

The ignition system 16 includes one or more igniter plugs 44, such as electrodes for example, and an ignition coil 46 which is used to boost the voltage supplied to the plugs 44. When the atomized fuel/air mixture is sprayed into the combustion chamber 32, it mixes with the combustion air and is ignited via a spark generated from the igniter plugs 44. This activates the fuel-fired burner to increase heat for filter regeneration as known.

The fuel supply system 18 includes a fuel injector 48, a fuel tank 50, a fuel filter 52, and a fuel pump 54. A fuel pressure sensor 56 and pressure regulator 58 monitor and control the amount of fuel pumped from the fuel tank 50 to be atomized within the atomization module 40. The air supply system 20 includes an air tank 60, a control valve 62, and an air pressure sensor 64 which operate together to delivered a desired amount of air to be atomized with the fuel delivered by the fuel injector 48 within the atomization module 40.

In addition to the fuel pressure sensor 56 and the air pressure sensor 64, the TR system 10 includes a plurality of other sensors which monitor/measure various system characteristics. For example, the TR system 10 includes a combustion air temperature sensor 70 located near the chamber inlet 38 of the fuel-fired burner 14 and a flame temperature sensor 72 that measure the flame temperature within the combustion chamber 32. An exhaust inlet temperature sensor 74 is located at the inlet 30 and an exhaust outlet temperature sensor 76 is located at the outlet 36. A voltage sensor 78 is used to measure battery voltage of the fuel pump 54 and a current sensor 80 is used to measure current flowing through the fuel pump 54. Another voltage sensor 82 measures the voltage of the ignition coil 46. Each of these sensors, and any additional sensors that may be required, communicate measurements/data to a burner control unit (BCU) 90 of a control system. The control system then uses this information to identify any of various specific component failures within the TR system 10.

Figure 2:
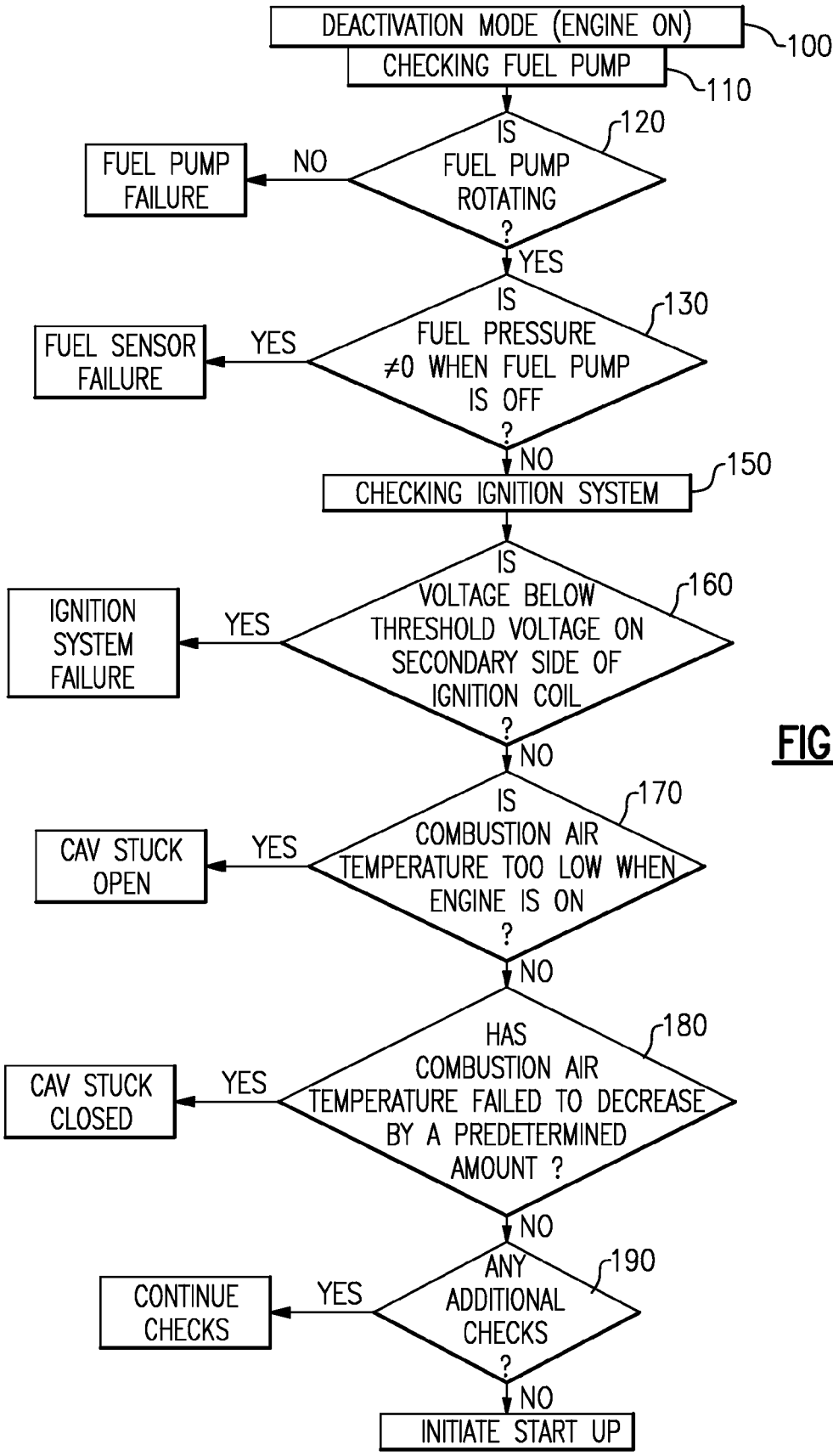
FIG. 2 is a flowchart describing the method for detecting fuel pump and ignition system failures.

FIG. 2 shows one example of a method used to identify a component failure within the TR system 10. As indicated at step 100, the system starts in a deactivation mode with the engine 12 running. The BCU 90 then monitors at least one of a fuel pump characteristic for the fuel pump 54 and an ignition system characteristic for the ignition system 16. The BCU 90 can monitor these characteristics simultaneously, separately, or individually depending on system requirements.

As shown at step 110, the system initiates a fuel pump check which includes monitoring the fuel pump characteristic and communicating this characteristic to the BCU 90. The BCU 90 then compares the fuel pump characteristic to a predetermined fuel pump criteria and identifies a fuel pump failure when the fuel pump characteristic does not meet the fuel pump criteria.

As shown at step 150, the system initiates an ignition system check which includes monitoring the ignition system characteristic and communicating this characteristic to the BCU 90. The BCU 90 then compares the ignition system characteristic to a predetermined ignition system criteria and identifies an ignition system failure when the ignition system characteristic does not meet the ignition system criteria.

Once a failure is identified, the BCU 90 communicates any fuel pump and ignition system failures to an end user via a warning signal 200 (FIG. 1) and corresponding specified component fault code. For example, a vehicle operator may receive a warning that there is a system failure via activation of a warning lamp or audio warning indicator 202. Further, an end user can communicate with the BCU 90 to receive the data/fault code which would identify which specific component has failed.

In one example, as shown at step 120 in FIG. 2, the fuel pump criteria comprises a resistance threshold and the step of monitoring the fuel pump characteristic includes monitoring a resistance of the fuel pump 54. The BCU 90 compares the resistance of the fuel pump 54 to the resistance threshold and identifies a fuel pump failure when the resistance falls below the resistance threshold. The BCU 90 monitors battery voltage measured by the voltage sensor 78 and monitors current flowing through the fuel pump 54 with the current sensor 80. The BCU 90 then determines a resistance of the fuel pump 54 using the equation of Ohm's Law, i.e. V (voltage)=I (current)×R (resistance). The BCU 90 continually determines this resistance over time and uses this to determine whether or not the fuel pump 54 is in a locked condition where a rotor of the fuel pump 54 is not able to rotate.

The resistance of the fuel pump 54 is significantly lower when the fuel pump 54 is stationary (non-rotating) as compared to when the fuel pump 54 is rotating. As discussed above, the BCU 90 continuously determines the resistance over time and if the resistance is too low, then a "fuel pump current over limit" fault will be activated. In one example, the resistance threshold is set within a range of 1-2 ohms; however, other values could also be used.

In one example, as shown at step 130 in FIG. 2, the fuel pump criteria comprises a fuel pressure threshold and the step of monitoring the fuel pump characteristic includes measuring a fuel pressure of the fuel pump with the fuel pressure sensor 56. The BCU 90 compares the fuel pressure of the fuel pump 54 to the fuel pressure threshold and identifies a fuel pump pressure sensor failure when the fuel pressure falls below the fuel pressure threshold. In one example, the fuel pressure threshold comprises a non-zero fuel pressure value the fuel pressure is measured while the fuel pump 54 is turned off. When the fuel pump 54 is turned off, if the sensor 56 does not have a reading of zero pressure then this is an indication of a fuel pump pressure sensor failure.

Further, if the fuel pressure is lower than expected yet not close to zero, the BCU 90 must be able to distinguish between a failed fuel pressure regulator and a failure due to worn vanes. If the fuel pressure is low due to worn vanes, then when fuel is injected through a fuel injector, the fuel pressure will decrease significantly, such as more than 15% for example.

As discussed above, at step 150 the system initiates an ignition system check which includes monitoring the ignition system characteristic and communicating this characteristic to the BCU 90. In one example, as indicated at step 160, the predetermined ignition system criteria comprises a voltage threshold and the step of monitoring the ignition system characteristic includes measuring a voltage of the ignition coil 46. As known, the ignition coil 46, which is used to boost voltage for ignition, has a primary side and a secondary side that has a higher voltage than the primary side. The voltage sensor 82 measures voltage at the secondary side and the BCU 90 compares this voltage to the voltage threshold and identifies an ignition system failure if the voltage of the ignition coil 46 falls below the voltage threshold.

The voltage output by the ignition coil 46 is monitored by the BCU 90 via a feedback circuit. The feedback circuit produces a voltage that is proportional to the igniter voltage. If the feedback voltage is not within an acceptable range when the ignition system is activated, then the ignition system has failed.

In one example, as indicated at step 170, the predetermined ignition system criteria comprises a combustion air temperature threshold and the step of monitoring the ignition system characteristic includes measuring a temperature of combustion air communicated from the engine 12 to the combustion chamber 32 of the fuel-fired burner 14 with the combustion air temperature sensor 70. The BCU 90 compares the temperature of combustion air entering the combustion chamber 32 to the combustion air temperature threshold and identifies that the combustion air valve 26 is stuck open if the temperature of the air entering the combustion chamber 32 falls below the combustion air temperature threshold by a predetermined amount.

Combustion air from the turbocharger 22 is combined with the atomized fuel/air mixture from the atomization module 40 in the combustion chamber 32 in order to produce a good, stable flame. The BCU 90 monitors the combustion air temperature as the combustion air enters the chamber, and when the engine 12 is running, this temperature should be relatively close to an exhaust gas temperature of the engine exhaust gases. If the combustion air temperature is not within a certain threshold range during this type of engine condition then it is an indication of a problem with the combustion air valve 26. If the temperature is too low, it is an indication that the combustion air valve 26 is stuck open.

If the combustion air valve is stuck closed, then the temperature will not decrease when the valve receives an activation command. To determine whether the combustion air valve 26 is stuck closed, the BCU 90 determines an initial combustion temperature when the engine is on and then monitors the temperature over a period of time as indicated at step 180. If the combustion air temperature does not decrease by a certain percentage, such as by 25% for example, it is an indication that the combustion air valve 26 is stuck closed.

Next, the control system determines if any additional checks are needed as indicated at step 190. If so, the BCU 90 continues with the additional checks. If not, the BCU 90 then initiates a start-up cycle.

Although a preferred embodiment of this invention has been disclosed, a worker of ordinary skill in this art would recognize that certain modifications would come within the scope of this invention. For that reason, the following claims should be studied to determine the true scope and content of this invention.

What is claimed is:

1. A method of identifying a component failure within a thermal regenerator system for a vehicle comprising the steps of:

(a) providing a burner control unit to control a thermal regenerator system and to detect a plurality of system failures at a component level;

(b) monitoring at least one of a fuel pump characteristic for a fuel pump in the thermal regenerator system and an ignition system characteristic for an ignition system in the thermal regenerator system, wherein the fuel pump is used to supply fuel to a fuel-fired burner and the ignition system is used to ignite fuel supplied to the fuel-fired burner;

(c) communicating the fuel pump characteristic to the burner control unit and comparing the fuel pump characteristic to a predetermined fuel pump criteria when monitoring the fuel pump characteristic of step (b), wherein the fuel pump criteria comprises a fuel pressure threshold and including a fuel pressure sensor to measure a fuel pressure of the fuel pump;

(d) communicating the ignition system characteristic to the burner control unit and comparing the ignition system characteristic to a predetermined ignition system criteria when monitoring the ignition system characteristic in step (b);

(e) identifying a fuel pump failure when the fuel pump characteristic does not meet the fuel pump criteria, wherein the burner control unit compares the fuel pressure of the fuel pump to the fuel pressure threshold and identifies a fuel pump pressure sensor failure when the fuel pressure varies front the fuel pressure threshold, and wherein the fuel pressure threshold comprises any non-zero fuel pressure value and wherein the burner control unit generates a control signal to measure the fuel pressure with the fuel pump pressure sensor while the fuel pump is turned off, and wherein the burner control unit identifies the fuel pump pressure sensor failure when the fuel pressure sensor generates a non-zero fuel pressure value when the fuel pump is off; and identifying an ignition system failure when the ignition system characteristic does not meet the ignition system criteria.

2. The method of claim 1 including (g) communicating fuel pump and ignition system failures to an end user via a warning signal and corresponding specified component fault code.

3. The method of claim 1 wherein step (b) includes monitoring both the fuel pump characteristic and the ignition system characteristic.

4. The method of claim 1 wherein the predetermined ignition system criteria comprises a voltage threshold and wherein the step of monitoring the ignition system characteristic includes measuring a voltage of an ignition coil and step (f) includes comparing the voltage of the ignition coil to the voltage threshold and identifying an ignition system failure if the voltage of the ignition coil falls below the voltage threshold.

5. The method of claim 1 including configuring the ignition system to include one or more igniter plugs extending into an inlet to a combustion chamber supported within a burner housing of the fuel-fired burner which is positioned downstream of an engine.

6. The method of claim 1 wherein the fuel pump criteria further comprises a resistance threshold and wherein the step of monitoring the fuel pump characteristic includes monitoring a resistance of the fuel pump and step (e) includes comparing the resistance of the fuel pump to the resistance threshold and identifying a fuel pump failure when the resistance falls below the resistance threshold.

7. The method of claim 6 including measuring battery voltage and current flowing through the fuel pump and subsequently calculating the resistance of the fuel pump.

8. A method of identifying a component failure within a thermal regenerator system for a vehicle comprising the steps of:

(a) providing a burner control unit to control a thermal regenerator system and to detect a plurality of system failures at a component level;

(b) monitoring at least one of a fuel pump characteristic for a fuel pump in the thermal regenerator system and an ignition system characteristic for an ignition system in the thermal regenerator system, wherein the fuel pump is used to supply fuel to a fuel-fired burner and the ignition system is used to ignite fuel supplied to the fuel-fired burner;

(c) communicating the fuel pump characteristic to the burner control unit and comparing the fuel pump characteristic to a predetermined fuel pump criteria when monitoring the fuel pump characteristic of step (b), wherein the fuel pump criteria comprises a fuel pressure threshold and wherein the step of monitoring the fuel pump characteristic includes measuring a fuel pressure of the fuel pump;

(d) communicating the ignition system characteristic to the burner control unit and comparing the ignition system characteristic to a predetermined ignition system criteria when monitoring the ignition system characteristic in step (b);

(e) identifying a fuel pump failure when the fuel pump characteristic does not meet the fuel pump criteria, which includes comparing the fuel pressure of the fuel pump to the fuel pressure threshold and identifying a fuel pump pressure sensor failure when the fuel pressure varies from the fuel pressure threshold, wherein the fuel pressure threshold comprises any non-zero fuel pressure value and including measuring the fuel pressure with a fuel pump pressure sensor while the pump is turned off, and identifying the fuel pump pressure sensor failure when the fuel pressure sensor generates a non-zero fuel pressure value when the fuel pump is off; and (f) identifying an ignition system failure when the ignition system characteristic does not meet the ignition system criteria.

9. A method of identifying a component failure within a thermal regenerator system for a vehicle comprising the steps of:

(a) providing a burner control unit to control a thermal regenerator system and to detect a plurality of system failures at a component level;

(b) monitoring at least one of a fuel pump characteristic for a fuel pump in the thermal regenerator system and an ignition system characteristic for an ignition system in the thermal regenerator system, wherein the fuel pump is used to supply fuel to a fuel-fired burner and the ignition system is used to ignite fuel supplied to the fuel-fired burner;

(c) communicating the fuel pump characteristic to the burner control unit and comparing the fuel pump characteristic to a predetermined fuel pump criteria when monitoring the fuel pump characteristic of step (b);

(d) communicating the ignition system characteristic to the burner control unit and comparing the ignition system characteristic to a predetermined ignition system criteria when monitoring the ignition system characteristic in step (b), wherein the predetermined ignition system criteria comprises a combustion air temperature threshold and wherein the step of monitoring the ignition system characteristic includes measuring a temperature of combustion air communicated from an engine to a combustion chamber of the fuel-fired burner;

(e) identifying a fuel pump failure when the fuel pump characteristic does not meet the fuel pump criteria; and (f) identifying an ignition system failure when the ignition system characteristic does not meet the ignition system criteria, which includes comparing the temperature of combustion air entering the combustion chamber to the combustion air temperature threshold and identifying that a combustion air valve is stuck open if the temperature of the air entering the combustion chamber falls below the combustion air temperature threshold by a predetermined amount.

10. A method of identifying a component failure within a thermal regenerator system for a vehicle comprising the steps of:

(a) providing a burner control unit to control a thermal regenerator system and to detect a plurality of system failures at a component level;

(b) monitoring at least one of a fuel pump characteristic for a fuel pump in the thermal regenerator system and an ignition system characteristic for an ignition system in the thermal regenerator system, wherein the fuel pump is used to supply fuel to a fuel-fired burner and the ignition system is used to ignite fuel supplied to the fuel-fired burner;

(c) communicating the fuel pump characteristic to the burner control unit and comparing the fuel pump characteristic to a predetermined fuel pump criteria when monitoring the fuel pump characteristic of step (b);

(d) communicating the ignition system characteristic to the burner control unit and comparing the ignition system characteristic to a predetermined ignition system criteria when monitoring the ignition system characteristic in step (b), wherein the predetermined ignition system criteria comprises an initial combustion air temperature measurement and wherein the step of monitoring the ignition system characteristic includes measuring a temperature of combustion air communicated from an engine to a combustion chamber of the fuel-fired burner;

(e) identifying a fuel pump failure when the fuel pump characteristic does not meet the fuel pump criteria; and (f) identifying an ignition system failure when the ignition system characteristic does not meet the ignition system criteria, which includes comparing the temperature of combustion air entering the combustion chamber to the initial combustion air temperature measurement and identifying that a combustion air valve is stuck closed if the temperature of the air entering the combustion chamber does not fall below the initial combustion air temperature measurement by a predetermined amount.

11. A control system for identifying a component failure within a thermal regenerator system for a vehicle comprising:

a burner control unit that controls a thermal regenerator system and detects a plurality of system failures at a component level;

a fuel pump that supplies fuel to a fuel-fired burner in the thermal regenerator system;

an ignition system that ignites fuel supplied to the fuel-fired burner;

wherein the burner control unit monitors at least one of a fuel pump characteristic for the fuel pump and an ignition system characteristic for the ignition system, and wherein the burner control unit compares the fuel pump characteristic to a predetermined fuel pump criteria when monitoring the fuel pump characteristic and compares the ignition system characteristic to a predetermined ignition system criteria when monitoring the ignition system characteristic, wherein the predetermined ignition system criteria comprises a combustion air temperature threshold;

a temperature sensor to measure a temperature of combustion air communicated from an engine to a combustion chamber of the fuel-fired burner;

wherein the burner control unit identifies a fuel pump failure when the fuel pump characteristic does not meet the fuel pump criteria and identifies an ignition system failure when the ignition system characteristic does not meet the ignition system criteria, and wherein the burner control unit generates a warning indication with a corresponding specified component fault code to an end user in response to identification of fuel pump and ignition system failures; and wherein the burner control unit compares the temperature of the combustion air entering the combustion chamber to the combustion air temperature threshold and identifies that a combustion air valve is stuck open if the temperature of the air entering the combustion chamber falls below the combustion air temperature threshold by a predetermined amount.

12. The control system of claim 11 wherein the burner control unit simultaneously monitors both the fuel pump characteristic and the ignition system characteristic.

13. The control system of claim 11 wherein the predetermined ignition system criteria comprises a voltage threshold and including a voltage sensor to measure a voltage of an ignition coil, and wherein the burner control unit compares the voltage of the ignition coil to the voltage threshold and identifies an ignition system failure if the voltage of the ignition coil falls below the voltage threshold.

14. The control system of claim 11 wherein the predetermined ignition system criteria comprises a combustion air temperature threshold and including a temperature sensor to measure a temperature of combustion air communicated from an engine to a combustion chamber of the fuel-fired burner, and wherein the burner control unit compares the temperature of the combustion air entering the combustion chamber to the combustion air temperature threshold and identifies that a combustion air valve is stuck open if the temperature of the air entering the combustion chamber falls below the combustion air temperature threshold by a predetermined amount.

15. The control system of claim 11 wherein the burner control unit is configured to monitor the at least one of a fuel pump characteristic for the fuel pump and the ignition system characteristic for the ignition system during vehicle operation to identify fuel pump and ignition system failures during vehicle operation.

16. The control system of claim 11 wherein during vehicle operation the ignition system comprises one or more igniter plugs extending into an inlet to a combustion chamber supported within a burner housing of the fuel-fired burner which is positioned downstream of an engine.

17. The control system of claim 11 wherein the burner control unit continuously monitors fuel pump and ignition system characteristics over time to identify system failures at a component level.

18. The method of claim 1 including configuring the burner control unit to continuously monitor the at least one of a fuel pump characteristic for the fuel pump and the ignition system characteristic for the ignition system to identify system failures during vehicle operation.

19. The control system of claim 11 wherein the fuel pump criteria comprises a resistance threshold and wherein the burner control unit monitors a resistance of the fuel pump and compares the resistance of the fuel pump to the resistance threshold and identifies a fuel pump failure when the resistance falls below the resistance threshold.

20. The control system of claim 19 including a voltage sensor to measure battery voltage of the fuel pump and a current sensor to measure current flowing through the fuel pump, and wherein the burner control unit determines the resistance of the fuel pump based on the battery voltage and current of the fuel pump.

21. A control system for identifying a component failure within a thermal regenerator system for a vehicle comprising:

a burner control unit that controls a thermal regenerator system and detects a plurality of system failures at a component level;

a fuel pump that supplies fuel to a fuel-fired burner in the thermal regenerator system;

an ignition system that ignites fuel supplied to the fuel-fired burner;

wherein the burner control unit monitors at least one of a fuel pump characteristic for the fuel pump and an ignition system characteristic for the ignition system, and wherein the burner control unit compares the fuel pump characteristic to a predetermined fuel pump criteria when monitoring the fuel pump characteristic and compares the ignition system characteristic to a predetermined ignition system criteria when monitoring the ignition system characteristic;

a temperature sensor to measure a temperature of combustion air communicated from an engine to a combustion chamber of the fuel-fired burner, and wherein the predetermined ignition system criteria comprises an initial combustion air temperature measurement;

wherein the burner control unit identifies a fuel pump failure when the fuel pump characteristic does not meet the fuel pump criteria and identifies an ignition system failure when the ignition system characteristic does not meet the ignition system criteria, and wherein the burner control unit generates a warning indication with a corresponding specified component fault code to an end user in response to identification of fuel pump and ignition system failures; and wherein the burner control unit compares a subsequently measured temperature of combustion air entering the combustion chamber to the initial combustion air temperature measurement and identifies that a combustion air valve is stuck closed if the temperature of the air entering the combustion chamber does not fall below the initial combustion air temperature measurement by a predetermined amount.

* * * * *